United States Patent [19]

Majkrzak

[11] Patent Number: 4,986,012

[45] Date of Patent: Jan. 22, 1991

[54] RETRACTABLE DRIFT CUTTER

[75] Inventor: David S. Majkrzak, West Fargo, N. Dak.

[73] Assignee: Crary Company, Fargo, N. Dak.

[21] Appl. No.: 425,695

[22] Filed: Oct. 23, 1989

[51] Int. Cl.[5] ..... E01H 5/09

[52] U.S. Cl. ..... 37/248; 37/244; 37/196

[58] Field of Search ..... 37/211, 220, 221, 222, 37/241, 242, 244, 248, 263, 251, 274, 281, DIG. 3, 196

[56] References Cited

U.S. PATENT DOCUMENTS

| | | | |
|---|---|---|---|
| 1,837,087 | 12/1931 | Wandscheer | 37/251 |
| 2,198,237 | 4/1940 | Voorderman | 37/258 |
| 2,610,414 | 9/1952 | Vanvick | 37/251 |
| 2,736,112 | 2/1956 | Boissonnault | 37/251 X |
| 2,777,217 | 1/1957 | Klaver | 37/251 X |
| 2,977,695 | 4/1961 | Kesecker | 37/260 X |
| 4,498,253 | 2/1985 | Schmidt | 37/249 |

*Primary Examiner*—Dennis L. Taylor
*Assistant Examiner*—J. Russell McBee
*Attorney, Agent, or Firm*—Kinney & Lange

[57] ABSTRACT

A motorized rotary blade snowblower is used for the removal of snow. This snowblower has a housing which covers the rotary blades and a drift cutting arm that is fastened to and extends p from the sides of the housing. The drift cutter is fastened to the housing so that it can be locked in a working position and retracted to a storage position.

9 Claims, 2 Drawing Sheets

RETRACTABLE DRIFT CUTTER

BACKGROUND OF THE INVENTION

1. Field of the Invention

The present invention relates to motorized rotary snowblowers, and more particularly to drift cutter attachments that extend up from a rotor housing for use and are retractable to a storage position.

2. Description of the Prior Art

Snowblowers disclosed in the prior art include drift cutting arms fastened to and extending up from the sides of the snowblower housings, but none of these drift cutters are retractable for the purpose of storage.

U.S. Pat. No. 4,498,253 illustrates a snowblower device that has short drift cutter blades extending from the upper edges of the sides of the housing. These blades are removable but not retractable.

U.S. Pat. No. 2,977,695 shows an adjustable drift cutter on a hand snow remover. However, only the length of the drift cutter is adjustable, rather than the entire cutter arm being retractable.

U.S. Pat. No. 2,610,414 shows a rotary snowblower which has a cutter blade that is spring-loaded in a working position and will retract when it hits an obstacle, but this cutter arm is of a different type than the outwardly extending arm of the present invention in that it is integral with a bottom scoop blade and not retractable for storage.

U.S. Pat. No. 2,198,237 shows an oscillating slicer bar that is mounted on side arms and extends across the front of the rotor housing. The arm and base pivot or oscillate up and down as the snowplow moves forward. A plurality of stationary cutters are positioned on the end plates of the rotor housing but they do not retract.

U.S. Pat. No. 1,837,087 shows a bar which can be adjusted lengthwise or removed but does not pivot to a retracted storage position.

SUMMARY OF THE INVENTION

A motorized rotary snowblower has a housing for the rotor, with an open front and a pair of side walls. Drift cutting arms are fastened to and extend up from the side walls of the rotor housing. In the present invention, the drift cutting arms are fastened to the side walls of the rotor housing so that they can be locked in a working position and retracted to a storage position.

A convenient and quick way to change the drift cutters from use to non-use in light snowdrift conditions and for overnight and off-season storage is thus provided. Drift cutters in their working position extend overall machine length for storage and do not allow the machine to get as close to walls when moving forwardly. With the present invention, the arms are retracted except when needed, and when they are retracted, they are shielded and out of the way so they are not bumped into. The drift cutters can be quickly retracted in cold weather when wearing gloves and mittens and without using tools.

DETAILED DESCRIPTION OF THE PREFERRED EMBODIMENTS

Figure 1:
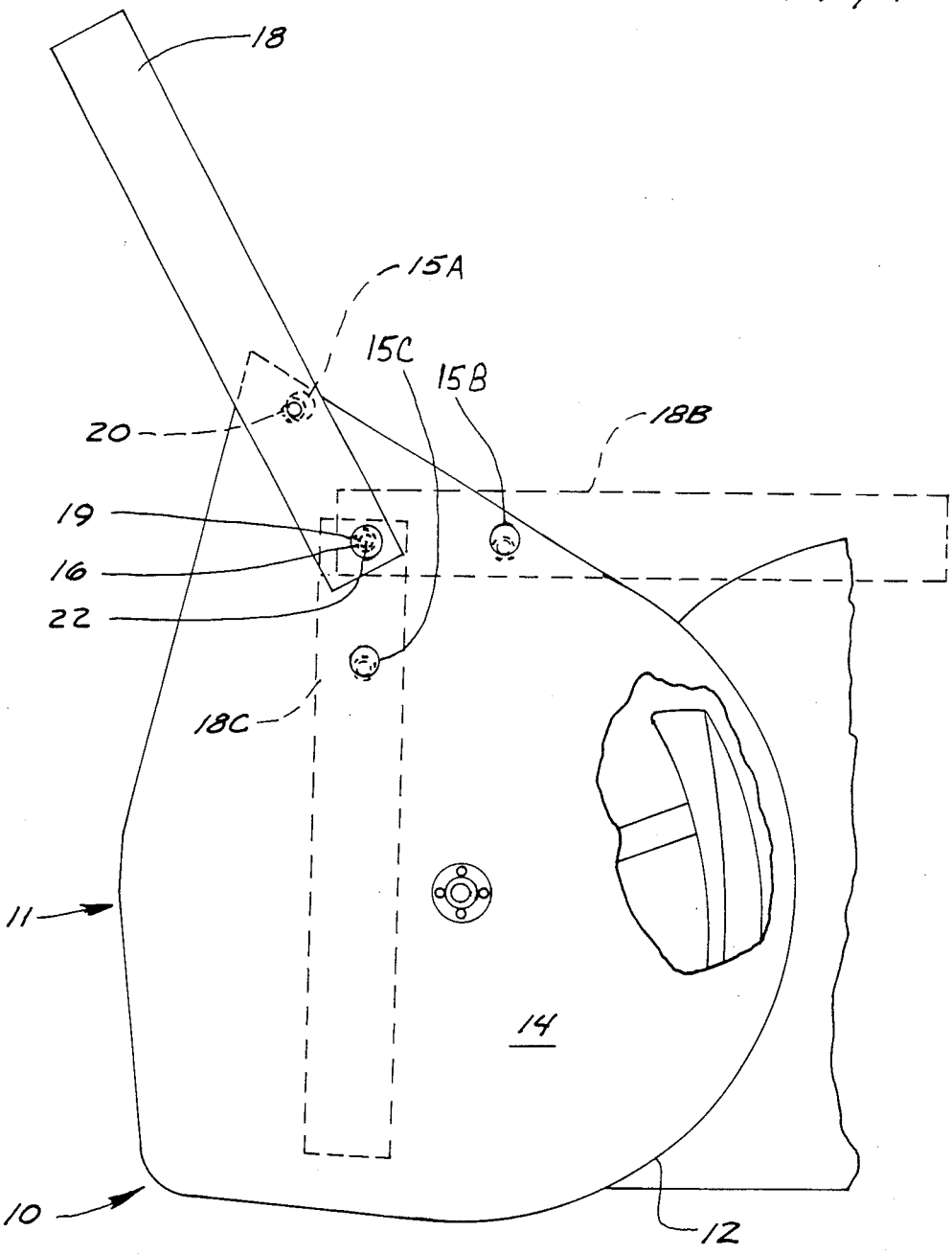
FIG. 1 is a fragmentary side view of a snowblower rotor housing showing a drift cutter arm in working position and in alternative retracted storage positions in dotted lines.

A snowblower, indicated generally at 10, includes a rotor housing 11 for a snowblower (also called a snowthrower) of conventional design, that has a curved rear wall 12 and side walls 14. In the preferred embodiment, the housing has a drift cutter arm 18 fastened to the exterior of each side wall 14. These cutter arms can also be fastened to the interior of the housing walls. The drift cutters 18 each have an aperture 19 at a pivot end and a headed rivet type lock pin 20 fixed to the arm and spaced from the aperture 19. The lock pins 20 may be spring release pins or simply bolts to be used with wing nuts. The side walls 14 have apertures 15A, 15B and 15C which are slightly larger than the head of lock pin 20 to receive lock pin 20 and prevent rotation of drift cutters 18. The side walls 14 also have an aperture 16 which receives a pivot bolt 22 to fasten the drift cutters to the side walls. Each bolt 22 is placed in the respective drift cutter aperture 19 and side wall aperture 16 and has a nut 28 to fasten the drift cutters 18 to the exterior of the side walls 14. A washer 24 is placed on the bolt 22 between the respective housing side wall 14 and drift cutter 18 so that the drift cutter is spaced from the housing side wall for clearance. The arm 18 can be made so it inclines toward the side wall near lock pin 20. A spring 26 is placed on each bolt 22 to the interior of the respective side wall 14 and is retained by nut 28. Each spring 26 clamps the drift cutter arm 18 to the washer 24 and yields under manual loads to permit moving the outer end of the drift cutter 18 away from the side wall 14. The spring clamping force can be adjusted by loosening or tightening nut 28. A lock nut can be used with nut 28 for security or an easily adjusted wing nut can be used in place of nut 28.

Alternatively, the cutter arms 18 can be retractable track-type assemblies wherein a portion slides in and out along a track or bracket.

The drift cutter 18 is locked into a working position extending upward and to the front of the snowblower housing 11 by placing the lock pin 20 in the side wall aperture 15A so that its shaft contacts an interior edge of aperture 15A to prevent pivoting of drift cutter 18. If the lock pin 20 is a spring release pin, it is released so that it snaps into the aperture 15A. If the lock pin 20 is a bolt, it is placed in aperture 15A and a wing nut is used to fasten the drift cutter 18 in a working position. The spring 26 and the head of bolt 22 prevent each drift cutter from moving outwardly from the side walls 14. If the cutter arms 18 are the track-type assemblies, a portion is slid along the track until fully extended and locked in position.

Figure 2:
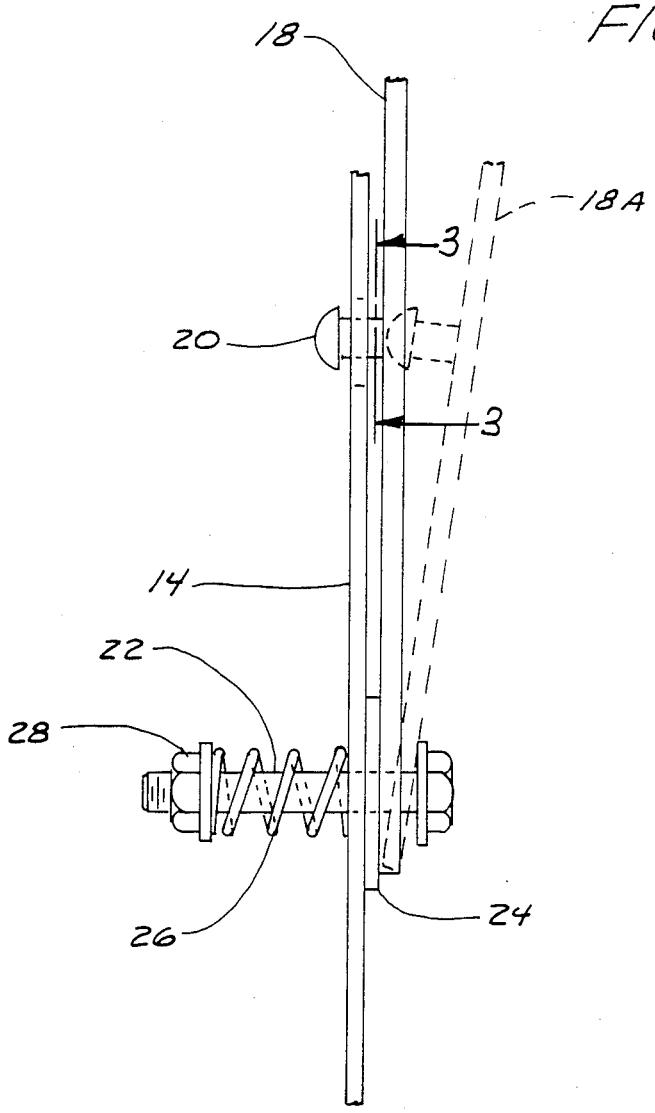
FIG. 2 is a fragmentary front view showing the fastening means of the present invention.
Figure 3:
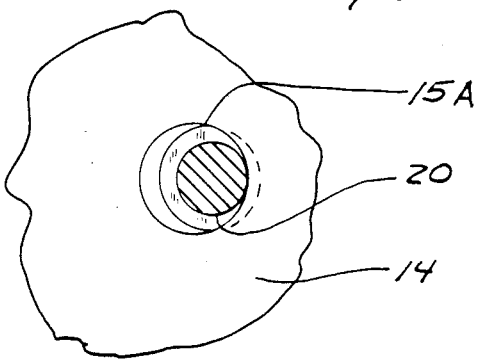
FIG. 3 is a fragmentary side view of a lock pin and receptacle taken along the line 3—3 in FIG. 2.

To lock the drift cutter arm 18 in a first storage position, the arm is initially pulled away from the housing side wall as shown in dotted lines at 18A in FIG. 2, and manipulated so the head of pin 20 passes through the aperture 15A to release the drift cutter arm. The drift cutter arm is rotated to a first storage position 18B as shown in dotted lines in FIG. 1, and locked into position by placing the lock pin 20 in the aperture 15B so that the pin/shaft contacts an edge of the aperture 15B.

The drift cutters of this invention are thus conveniently and quickly retractable to a storage position.

Alternatively, if the drift cutter arm 18 is in the way in horizontal position, the drift cutter arm can be moved to position 18C and the pin 20 locked in aperture 15C. In addition, if the cutter arm 18 is a track-type assembly for mounting, the extended portion would be slid along the track (which would be mounted to a side wall 14) until fully retracted and locked into position.

Thus, the arm will be held out of the way and positively prevented from moving from its stored position. The drift cutter arm can be held in any desired rotational position about its pivot pin for storage. The arm can be flat bars as shown, or could be channel shaped if desired. The arm cut into large drifts and provide a clean, complete cut along the path being cleared. The quick retraction possible with the present invention permits moving the arms to working positions for the intervals of time when needed and then permits getting them out of the way for the rest of the time.

Although the present invention has been described with reference to preferred embodiments, workers skilled in the art will recognize that changes may be made in form and detail without departing from the spirit and scope of the invention.

What is claimed is:

1. A snow removal apparatus, having a drift cutter arm that is fastened to and extends up from a housing, wherein the improvement comprises:

means for fastening the drift cutter arm to the housing which allows the drift cutter arm to be locked in a working position and retracted to a storage position while the drift cutter arm remains fastened to the housing, said fastening means comprising:

pivot pin means which fastens one end of the drift cutter arm to the housing and allows the drift cutter arm to pivotally move to the storage position;

a releasable lock pin cooperating between the drift cutter arm and the housing which releasably holds the drift cutter arm in a rigid working position; and the pivot pin means resiliently mounting the drift cutter arm to the housing so that a free end of the drift cutter arm can be moved outwardly and released from a locked position adjacent the housing and rotated to its storage position.

2. The apparatus of claim 1 wherein the releasable lock pin is fixed to the cutter arm.

3. The apparatus of claim 1 wherein the lock pin is fixed to the drift cutter arm, and at least one aperture in the housing which receives and holds the lock pin.

4. The apparatus as specified in claim 1, wherein the resiliently mounted pivot pin comprises a spring placed on the pivot pin.

5. The apparatus as specified in claim 1, wherein the resiliently mounted pivot pin comprises a spring retained on a bolt by a nut.

6. A motorized rotary snowblower, having a housing which covers a rotor for throwing snow and a drift cutter arm that is attached to and adjacent side walls of the housing and that extends above and beyond the front of the housing, wherein the improvement comprises:

a pivot pin pivotally fastening an end of the drift cutter arm to the outside of a housing side wall, and of sufficient length to hold a spring;

a spring placed on the pivot pin to urge the drift cutter arm to be supported against a surface of the housing;

means for retaining the spring on the pivot pin; and a lock pin mounted on the drift cutter arm which cooperates with the housing and holds the drift cutter arm in a working position, and which is releasable so that the drift cutter arm can pivotally retract to a storage position.

7. A drift cutter arm for use with a snow blower having a powered rotor mounted in a housing having generally upright side walls at opposite ends of the rotor and at least a pair of spaced apertures in each of the side walls, the drift cutter arm having means for movably mounting the arm on a side wall of the housing, including a pivot pin adjacent an end of the drift cutter arm for mounting in a first aperture of one side wall of the housing, the pivot pin being slidably mounted axially through an aperture in the drift cutter arm, means on the arm for locking the arm in a working position and permitting movement to a retracted position while the arm remains coupled to the means for movably mounting, including a lock pin having a shaft and a head fixed to the drift cutter arm with the head spaced from the surface of the drift cutter arm, the lock pin being spaced from the pivot pin, the head of the lock pin being of size to closely pass through a second aperture in the side wall of a housing, and a spring mounted on the pivot pin for urging a lock bar in direction toward a surface of a side wall of the housing with the pivot pin in the first aperture and with the lock pin held extending through the second aperture.

8. The drift cutter arm of claim 7 wherein the spring is selected to permit the drift cutter arm to be canted away from the side wall sufficiently to move the lock pin to position clear the side wall and permit the drift cutter arm to pivot on the pivot pin.

9. A drift cutter arm kit for use with a snow blower having a powered rotor mounted in a housing having generally upright side walls at opposite ends of the rotor and at least a pair of spaced apertures in at least one side wall, the drift cutter arm kit including a pivot pin, the drift cutter arm having an aperture adjacent an end thereof for slidably mounting the pivot pin, the pivot pin being mountable in a first aperture of one side wall of a housing with which the kit is used, a lock pin having a shaft and a head fixed to the drift cutter arm with the head spaced from an adjacent surface of the drift cutter arm, the lock pin being spaced from the aperture in the drift cutter arm for the pivot pin, the head of the lock pin being of size to closely pass through a second aperture in the side wall of a housing with which the kit is used, a spring mountable on the pivot pin, and means for cooperating with the pivot pin for retaining the spring on the pivot pin for urging the drift cutter arm in direction toward a surface of a side wall of a housing with which the kit is used when the pivot pin is in a first aperture of such a side wall and with the lock pin held extending through a second aperture of such a side wall.

* * * * *